United States Patent [19]

Wierenga et al.

[11] Patent Number: 5,002,681

[45] Date of Patent: Mar. 26, 1991

[54] JUMBO PARTICULATE FABRIC SOFTNER COMPOSITION

[75] Inventors: Thomas J. Wierenga; Charles A. Hensley, both of Cincinnati; Ricky A. Pollard, Moscow; Bernard K. Kremer, Cincinnati, all of Ohio

[73] Assignee: The Procter & Gamble Company, Cincinnati, Ohio

[21] Appl. No.: 335,917

[22] Filed: Apr. 10, 1989

Related U.S. Application Data

[63] Continuation-in-part of Ser. No. 318,778, Mar. 3, 1989, abandoned.

[51] Int. Cl.[5] ..... C11D 1/08; C11D 1/86; C11D 9/46

[52] U.S. Cl. ..... 252/90; 252/8.6; 252/8.8; 252/8.9; 252/547

[58] Field of Search ..... 252/90, 8.6, 8.8, 8.9, 252/174.13, 547

[56] References Cited

U.S. PATENT DOCUMENTS

| | | | |
|---|---|---|---|
| 3,936,537 | 2/1976 | Baskerville, Jr. et al. | 427/242 |
| 4,095,946 | 6/1978 | Jones et al. | 8/137 |
| 4,118,525 | 10/1978 | Jones | 427/242 |
| 4,223,029 | 9/1980 | Mahler et al. | 427/242 |
| 4,638,907 | 1/1987 | Bedenk et al. | 252/93 |
| 4,663,198 | 5/1987 | Norris | 427/264 |
| 4,733,774 | 3/1988 | Ping, III et al. | 8/137 |
| 4,740,326 | 4/1988 | Hortel et al. | 252/90 |
| 4,828,746 | 5/1989 | Clauss et al. | 252/90 |

*Primary Examiner*—Paul Lieberman
*Assistant Examiner*—John F. McNally
*Attorney, Agent, or Firm*—Leonard Williamson; Robert B. Aylor; Richard C. Witte

[57] ABSTRACT

A pouched, detergent-compatible, through-the-wash, dryer-released, jumbo particulate fabric softening composition. The particle size of this particulate is from about 5 mm to about 30 mm, and preferably at least 10 mm. The low viscoisty jumbo particulate fabric softener is made to survive the wash more so than comparable smaller particulates and release more in the dryer than higher viscosity softener. The softener particulate of this invention has a low viscosity at about its melting point for good softener transferability from the pouch to the fabric, superior release in the dryer, and reduced residual pouch staining.

12 Claims, No Drawings

JUMBO PARTICULATE FABRIC SOFTNER COMPOSITION

CROSS-REFERENCE TO RELATED APPLICATION

This is a continuation-in-part of patent application U.S. Ser. No. 07/318,778, filed Mar. 3, 1989, now abandoned.

FIELD OF THE INVENTION

The invention pertains to fabric softener compositions which can be included with detergent in the washing of fabrics. The fabric softener survives the wash and releases softener to the fabrics in a heated laundry dryer.

BACKGROUND OF THE INVENTION

The advantages obtained from the application of fabric conditioning agents (i.e., fabric softeners and/or antistatic agents) to laundered fabrics are well known. The present invention pertains to particulate softener-/antistatic compositions which survive the wash process and release the active softening/antistatic agent to the laundered fabrics in the dryer.

U.S. Pat. No. 4,223,029, Mahler/Doumani, issued Sept. 16, 1980, discloses a product for use in softening clothing in a rotating dryer. Free-flowing particulate softening agent yields a positive charge to the ambient moist air. The softener particulate is in a moist, air-permeable packet.

Fabric softening and antistatic benefits are a desirable part of the laundry process. Softening and antistatic compounds are, in general, quaternary ammonium compounds that are not compatible with anionic surfactants. These compounds will be referred to hereinafter as fabric softening compounds or fabric softeners, although it is to be understood that they deliver both softening and antistatic benefits to fabrics. The opposite electrical charge of the anionic surfactant used in most detergents and the quaternary ammonium fabric softening compounds leads to a mutual attraction which causes precipitation. This, in effect, removes surfactant and fabric softener from solution and reduces the cleaning capacity of the detergent while preventing effective fabric softener deposition on the fabric.

One solution to this incompatibility problem is the separate addition of the fabric softener during either the rinse cycle of the wash or while the fabrics are in the dryer. This increases the inconvenience of using fabric softeners because of the need to add them at a point in the laundering process which is different from that at which the detergent is added.

Various other solutions for this problem of incompatibility between detergent and softening compounds have been proposed in the art. U.S. Pat. No. 3,936,537, Baskerville Jr., issued Feb. 3, 1976, and U.S. Pat. No. 4,095,946, Jones, issued June 20, 1978, both incorporated herein by reference, teach the use of intimate mixtures of organic dispersion inhibitors (e.g., stearyl alcohol and fatty sorbitan esters) with solid fabric softener to improve the survival of the softener in the presence of detergent in the washer so the softener can act on the fabrics when it melts in the dryer. U.S. Pat. No. 4,234,627, Schilling, issued Nov. 18, 1980, teaches microencapsulation of fabric softener. The microcapsules survive the wash and adhere to the fabric surface. They are then ruptured by subsequent tumbling of the fabric in the dryer, thereby releasing softener to the fabrics. Fabric softener prills with a water-insoluble coating are known. However, the commercial production of such softener prills is expensive and delivery efficiency in the dryer can be affected by the coating.

U.S. Pat. No. 4,659,496, Klemm et al., issued Apr. 21, 1987, discloses a dispensing pouch containing premeasured "washer resistant fabric softener . . . chips larger than the pouch valve openings." Klemm et al.'s exemplified softener has viscosity 30,000 to 40,000 cps.

Softeners with viscosities over 30,000 cps have an unacceptable level of fabric staining, low inefficient release in the dryer, as well as residue staining of the pouch from which the softener is delivered.

Thus, there is a continuing need for improved methods and compositions which are more suitable for conveniently and effectively preparing particulate fabric softeners for the home laundering process.

An object of the present invention is to provide a pouched jumbo softener particulate for reduced residual staining of the pouch after use.

It is also an object of the present invention to provide particulate fabric softener which survives the detergent wash solution and releases the softener to the fabrics at dryer temperatures.

Yet another object of the present invention is to provide a softener that will survive the wash process and release in the dryer without need of a coating.

Still another object of the present invention is to provide a softener with efficient softener release in the dryer.

SUMMARY OF THE INVENTION

The present invention is directed to detergent-compatible, through-the-wash, pouched, dryer-activated cationic fabric softener particles having diameters of from about 5,000 to about 30,000 microns and a melting point or dryer temperature viscosity of from about 8,000 cps to about 25,000 cps.

DETAILED DESCRIPTION OF THE INVENTION

The present invention is directed to detergent-compatible, through-the-wash, pouched, dryer-activated fabric softening particles comprising a jumbo cationic fabric softener particulate. This invention also relates to a method for using the jumbo particulate in in laundry detergent product. The invention also relates to laundry detergent compositions containing said jumbo softener particles. The jumbo fabric softener composition (particles) can be added to the wash step of the fabric laundering process inside of a through-the-wash pouch. It could also be added directly to the dryer if only dryer fabric conditioners are contained therein.

In general, the preferred softener particles of this invention have a diameter of at least 10,000 microns and do not require a coating to survive the wash solution and insure practical carry over into the dryer cycle of the laundry process. Reducing or eliminating the need for softener coatings increases the delivery efficiency of the softener in the dryer and ultimately reduces the amount of softener needed to maintain a given level of performance.

For production reasons, the preferred process of making the jumbo particulate comprises quench cooling molten fabric softener on a cooling device. The softener particles are formulated and designed to survive the wash and release softener actives to the fabrics in a heated laundry dryer.

It was surprising that so much of the low viscosity jumbo particulate survived the wash and from about 60% up to about 80% released in the dryer, which is a level of about twice that of higher viscosity softeners. Thus, softener loading can be reduced by about 50%. The present invention provides equal performance and less staining over the prior art. It was also surprising that it released in the dryer from the pouch with reduced residue staining of the pouch itself.

The Softner Particles

The detergent-compatible, through-the-wash, pouched, dryeractivated jumbo fabric softener particles of this invention are comprised of at least about 10% cationic fabric softener. The softener composition has a melting point of from about 40° C. to about 80° C., preferably from about 45° C. to about 60° C.

These jumbo softener particles do not require quench cooling. However, the preferred method for making the softener consists of quench cooling softener of the present invention by intimately contacting the molten fabric softener with a cooling device, preferably a moving belt cooler or a chilled roll to improve production efficiency. The molten fabric softener is metered onto the cooling device as a film or, preferably, as droplets.

Preferably, the molten fabric softener is applied to the cooling device as droplets having a preferred thickness of from about 2 mm to about 10 mm, more preferably from about 4 mm to about 8 mm, and most preferably from about 5 mm to about 7 mm, and a diameter of from about 5 mm to about 30 mm, more preferably from about 10 mm to about 20 mm, and most preferably from about 10 mm to about 15 mm.

In another preferred method, the molten softener is applied to the cooling device as a film having a thickness of from about 2 mm to about 10 mm, more preferably from about 4 mm to about 8 mm, and most preferably from about 5 mm to about 7 mm. Individual particles are then stamped, etc., with an appropriate die to give a particle with a diameter of from about 5 mm to about 30 mm, more preferably from about 10 mm to about 20 mm, and most preferably from about 10 mm to about 15 mm.

The jumbo fabric softener particles preferably have diameters in the range of from about 5,000 to about 30,000 microns, preferably from about 10,000 to about 20,000 microns, and more preferably from about 10,000 to about 15,000 microns. They are particularly useful in pouched product executions. A preferred softener composition is disclosed in Example I herein. The preferred pouch has two equal pockets each containing about one-half of normal amounts of detergent for the wash and softener for the dryer. The particles are preferably of a generally disc or spherical shape. The particle sizes quoted herein refer to the largest dimension (diameter, thickness or length) of the particle.

In preparing a preferred jumbo fabric softener particle of this invention, molten fabric softener is applied onto a quenching device having a temperature below the melting point of the softener composition. The molten softener can be applied to the cooling device in the form of particles, ribbons, sheets, etc., whereby the heat exchange occurring between the cooling device and softener quickly solidifies or quenches the molten softener solid.

A weir or a similar device can be used to meter a sheet or a ribbon of molten softener onto the cooling device. An electronically controlled pastille-forming apparatus or a screen printer can be used to provide uniform softener droplets.

Preferred cooling devices are steel belt coolers and chill rolls. A preferred cooling device commercially available is a Sandvik Rotoform System comprising drop formers or weirs, and a rotating steel belt cooler (Sandvik Process Systems, Inc., Totowa, N.J. 07512). Another cooling belt manufactured by the Berndorf International Conveyor Belts, Inc., Schaumburg, Ill., 60193. The cooling device must be capable of releasing the quench cooled softener product via doctoring or some other separation means and is thus distinguished from substrate impregnated, cooled softener.

Fabric Softener Viscosity

The fabric softener compositions of the present invention preferably have a viscosity of from about 5,000 cps to about 25,000 cps, more preferably from about 8,000 cps to about 20,000 cps, most preferably from about 10,000 cps to about 15,000 cps, at its melting point or at typical dryer temperatures of from about 50° C. to about 90° C.

Any softener composition additive which raises the viscosity level too much, e.g., certain clays, is avoided or used sparingly so as not to exceed the limit.

When the jumbo softener particulates have a particle size of below about 7,000 microns, it is preferred that the viscosity be below about 15,000 cps, preferably between 8,000 and 14,000 cps. However, regardless of the size of the particulate, such lower viscosities are desirable because the softener is more fluid and can pass more readily through the pores of the pouch product substrate to the fabrics in the dryer with less residual pouch staining.

Fabric Softener "Masking" Adjuvant

The "masking" adjuvants, or agents, are water-insoluble, particulate materials that have a particle size of from about 1 micron to about 15 microns, preferably with a mean of from about 2 microns to about 4 microns, more preferably about 2.5 microns. The particles are preferably irregular in shape to promote light diffraction. Smaller particles can be present, but are relatively ineffective and larger particles are undesirable from an efficiency standpoint. A relatively tight distribution of particles is preferred. The particle size range is typically from about 1 micron to about 15 microns, preferably from about 2 to about 10 microns, more preferably from about 2.5 to about 6 microns, average diameter on a weight basis. In addition to the particles that are inside the above ranges, small amounts of particles outside said ranges can also be present. Particles within the said ranges are believed to be the operable particles.

The preferred masking adjuvant particles are the silica gels such as aerogels and xerogels and agglomerated fumed silicates. Aerogels are preferred. Suitable materials include Syloid® 234, Syloid® 235, Syloid® 244, and Syloid® 245.

The function of this adjuvant is threefold. The primary function is to reduce the number and/or size of visible deposits of fabric softener on fabrics. The adjuvant also reduces the shiny appearance of melted softener deposits on fabric surfaces. The third function of the adjuvant is that it can be used as a perfume carrier.

Perfumes are in general volatile and many perfume components can be destroyed or damaged by contact with cleaning ingredients, especially alkali and bleaches. One solution to this incompatibility problem is to adsorb the perfume on (includes adsorbed in) the silica. The perfume oil adsorption is affected by particle size (microns) and surface area ($m^2/g$). In general, the amount of perfume that can be adsorbed per unit weight of silica is greater for small particle sizes. However, it is usually preferred not to load the perfume particles to the maximum loading. Perfume to silica particle ratios can range from about 0.001:1 to about 6:1, depending upon the silica particle, with the preferred ratios being from about 0.01:1 to about 3:1, more preferably from about 0.2:1 to about 2.5:1.

The perfume can be sprayed onto the silica in various ways known in the trade. One such method is described in Example III.

In a "pouched" or "sheet" execution of the type described hereinafter, the pouch retains the fabric softener particles throughout the laundry process. When the pouch and the laundry (fabrics) are subsequently placed in the laundry dryer, the softener particles melt and/or are mobilized by the action of the heat and moisture so that said softener actives are transferred to the fabrics by contact between the pouch and the fabrics during the drying cycle. The temperatures in the clothes dryer can range from about 40° C. to about 120° C., but which more commonly do not exceed about 85° C. If said softener particles contain a perfumed adjuvant, the perfume is transferred to the fabrics with the fabric softener actives greatly improving its deposition efficiency.

In order to provide masking, the masking particles must be distributed (dispersed) throughout the softener and must remain dispersed. The amount of masking particles required is from about 4% to about 20%, preferably from about 6% to about 15%, and more preferably from about 8% to about 12%, by weight of the softener composition.

Fabric Softeners

Typical cationic fabric softeners useful herein are quaternary ammonium salts of the formula $$[R_1R_2R_3R_4N]^+Y^-$$

wherein one or two of $R_1$, $R_2$, $R_3$ and $R_4$ groups is an organic radical containing a group selected from a $C_{12}$–$C_{22}$ aliphatic radical or an alkylphenyl or alkylbenzyl radical having from 10 to 16 carbon atoms in the alkyl chain, the remaining groups being selected from $C_1$–$C_4$ alkyl, $C_2$–$C_4$ hydroxyalkyl and cyclic structures in which the nitrogen atom in the above formula forms part of the ring, and Y constitutes an anionic radical such as halide, nitrate, bisulfate, methylsulfate, ethylsulfate and phosphate, to balance the cationic charge.

In the context of the above definition, the hydrophobic moiety (i.e., the $C_{12}$–$C_{22}$ aliphatic, $C_{10}$–$C_{16}$ alkyl phenol or alkylbenzyl radical) in the organic radical $R_1$ or $R_2$ may be directly attached to the quaternary nitrogen atom or may be indirectly attached thereto through an amide, ester, alkoxy, ether, or like grouping.

The quaternary ammonium compounds useful herein include both water-soluble compounds and substantially water-insoluble compounds which are dispersible in water. For example, imidazolinium compounds of the structure

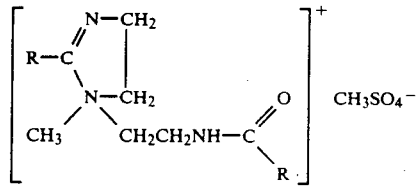

wherein R is a $C_{16}$ to $C_{22}$ alkyl group, possess appreciable water solubility, but can be utilized in the present invention.

The quaternary ammonium softener compounds used in this invention can be prepared in various ways well known in the art and many such materials are commercially available. The quaternaries are often made from alkyl halide mixtures corresponding to the mixed alkyl chain lengths in fatty acids. For example, the ditallowalkyl quaternaries are made from alkyl halides having mixed $C_{14}$–$C_{18}$ chain lengths. Such mixed di-long chain quaternaries are useful herein and are preferred from a cost standpoint.

The anionic group which can be the counter-ion in the quaternary compounds useful herein is typically a halide (e.g., chloride or bromide), nitrate, bisulfate, ethylsulfate, or methylsulfate. The methylsulfate and chloride ions are the preferred counter-ions from an availability standpoint; while the methylsulfate anion is most preferred because of its minimization of corrosive effects on the automatic clothes dryers in which it is used.

The following are representative examples of quaternary ammonium softening compounds suitable for use in the present invention. All the quaternary ammonium compounds listed can be included in the present invention, but the compilation of suitable quaternary compounds hereinafter is only by way of example and is not intended to be limiting of such compounds. Dioctadecyldimethylammonium methylsulfate is an especially preferred fabric softening compound for use herein, by virtue of its high antistatic, as well as fabric softening activity; ditallowalkyldimethylammonium methylsulfate is equally preferred because of its ready availability and its good antistatic activity; other useful di-long chain quaternary compounds are dicetyldimethylammonium chloride, didocosyldimethylammonium chloride, didodecyldimethylammonium chloride, ditallowalkyldimethylammonium bromide, dioleoyldimethylammonium methylsulfate, ditallowalkyldiethylammonium chloride, ditallowalkyldipropylammonium bromide, ditallowalkyldibutylammonium fluoride, cetyldecylmethylethylammonium chloride, bis-[ditallowalkyldimethylammonium] bisulfate, tris-[ditallowalkyldimethylammonium] phosphate, 1-methyl-1-tallowamidoethyl-2-tallowimidazolinium methylsulfate, and the like. Particularly preferred quaternary ammonium fabric softening compounds are ditallowalkyldimethylammonium chloride and ditallowalkyldimethylammonium methylsulfate.

The softener composition can consist entirely of cationic fabric softeners, and will generally comprise at least 10%, usually 10% to 50%, cationic fabric softener. Optionally, and preferably, the softener can contain additional materials such as perfume, auxiliary fabric softening agents (e.g., smectite clay, fatty alcohols and fatty amine, such as ditallowmethyl amine or 1-tallowamidoethyl-2-tallowimidazoline), soil release agents, fabric brighteners, etc. Additional disclosure of materials which can be applied to fabrics along with cationic fabric softening agents in a laundry dryer and, therefore, can be part of the core composition of the particles herein, are disclosed in U.S. Pat. No. 4,073,996, Bedenk et al., issued Feb. 14, 1978; U.S. Pat. No. 4,237,155, Kardouche, issued Dec. 2, 1980; and U.S. Pat. No. 4,421,792, Rudy et al., issued Dec. 20, 1983, all incorporated herein by reference. Preferred additional materials are the encapsulated fabric conditioning perfume microcapsules of U.S. Pat. No. 4,234,627, Schilling, issued Nov. 18, 1980, and British Pat. No. 1,549,432, both of which are incorporated herein by reference. A particularly preferred process for preparing such capsules is disclosed in U.S. Pat. No. 3,697,437, Fogle et al., issued Oct. 10, 1972, incorporated herein by reference. Particle sizes of from about 100 to about 200 microns are preferred.

The jumbo particles are used inside a pouch product, so it does not matter that the particle size of the softener particles is so much larger than the conventional particle size of detergent granules since product segregation is nonexistent.

Detergent Compositions

The particles of the present invention are preferably formulated into detergent compositions. Such compositions typically comprise detersive surfactants and detergency builders and, optionally, additional ingredients such as bleaches, enzymes, fabric brighteners and the like. The particles are present in the detergent composition at a level sufficient to provide from about 0.5% to about 10%, and preferably from about 1% to about 5% of quaternary ammonium fabric softener in the detergent composition. The remainder of the detergent composition will comprise from about 1% to about 50%, preferably from about 10% to about 25% detersive surfactant, and from about 15% to about 60%, preferably from about 20% to about 45% of a detergency builder, and, if desired, other optional laundry detergent components.

1. The Surfactant

Surfactants useful in the detergent compositions herein include well-known synthetic anionic, nonionic, amphoteric and zwitterionic surfactants. Typical of these are the alkyl benzene sulfonates, alkyl- and alkylether sulfates, paraffin sulfonates, olefin sulfonates, alkoxylated (especially ethoxylated) alcohols and alkyl phenols, amine oxides, alpha-sulfonates of fatty acids and of fatty acid esters, alkyl betaines, and the like, which are well known from the detergency art. In general, such detersive surfactants contain an alkyl group in the $C_9$–$C_{18}$ range. The anionic detersive surfactants can be used in the form of their sodium, potassium or triethanolammonium salts; the nonionics generally contain from about 5 to about 17 ethylene oxide groups. $C_{11}$–$C_{16}$ alkyl benzene sulfonates, $C_{12}$–$C_{18}$ paraffin-sulfonates and alkyl sulfates are especially preferred in the compositions of the present type.

A detailed listing of suitable surfactants for the detergent compositions herein can be found in U.S. Pat. No. 3,936,537, Baskerville, issued Feb. 3, 1976, incorporated by reference herein. Commercial sources of such surfactants can be found in McCutcheon's EMULSIFIERS AND DETERGENTS, North American Edition, 1984, McCutcheon Division, MC Publishing Company, also incorporated herein be reference.

2. Detergency Builders

Useful detergency builders for the detergent compositions herein include any of the conventional inorganic and organic water-soluble builder salts, as well as various water-insoluble and so-called "seeded" builders.

Nonlimiting examples of suitable water-soluble, inorganic alkaline detergent builder salts include the alkali metal carbonates, borates, phosphates, polyphosphates, tripolyphosphates, bicarbonates, silicates, and sulfates. Specific examples of such salts include the sodium and potassium tetraborates, bicarbonates, carbonates, tripolyphosphates, pyrophosphates, and hexametaphosphates.

Examples of suitable organic alkaline detergency builder salts are: (1) water-soluble amino polyacetates, e.g., sodium and potassium ethylenediaminetetraacetates, nitrilotriacetates, and N-(2-hydroxyethyl)nitrilodiacetates; (2) water-soluble salts of phytic acid, e.g., sodium and potassium phytates; (3) water-soluble polyphosphonates, including sodium, potassium and lithium salts of ethane-1-hydroxy-1,1-diphosphonic acid, sodium, potassium, and lithium salts of methylenediphosphonic acid and the like.

Seeded builders include such materials as sodium carbonate or sodium silicate, seeded with calcium carbonate or barium sulfate.

A detailed listing of suitable detergency builders can be found in U.S. Pat. No. 3,936,537, supra, incorporated herein by reference.

3. Optical Detergent Ingredients

Optional detergent composition components include enzymes (e.g., proteases and amylases), halogen bleaches (e.g., sodium and potassium dichloroisocyanurates), peroxyacid bleaches (e.g., diperoxydodecane-1,12-dioic acid), inorganic percompound bleaches (e.g., sodium perborate), activators for perborate (e.g., tetraacetylethylenediamine and sodium nonanoyloxybenzene sulfonate), soil release agents (e.g., methylcellulose), soil suspending agents (e.g., sodium carboxymethylcellulose), and fabric brighteners.

Pouched Products

If free jumbo fabric softener particles of the invention are added to the wash step of a laundering process, they would not adhere to or become trapped in the folds of the fabrics and would be lost in the wash. In order to avoid such loss, the jumbo particles are added to the wash solution in a sealed, porous water-insoluble pouch such as the type described in U.S. Pat. No. 4,223,029, Mahler et al., issued Sept. 16, 1980, incorporated by reference herein. Detergent granules can be included in the pouch with the softener particles. When the pouch is placed in water during the wash step of the laundering process, the detergent dissolves, but most (75–100%) of the softener particulate remains in the pouch. In a typical U.S. wash about 100% of the jumbo softener particles will survive a cold (60° F./15° C.) or warm (95° F./35° C.) water wash and about 75% will survive a hot (120° F./49° C.) water wash.

The pouch remains with the fabrics through the wash and rinse and is tumbled with the fabrics in the dryer. The softener melts onto the pouch material and is transferred from the pouch material to the fabrics as the pouch comes into contact with the fabrics during the drying cycle.

Preferred pouch structures are made of porous sheets such as described in commonly assigned U.S. Pat. No. 4,638,907, Bedenk/Harden, issued Jan. 27, 1987, and commonly assigned U.S. Ser. No. 178,747, filed Apr. 7, 1988, now U.S. Pat. No. 4,839,076, issued June 13, 1989 incorporated herein by reference. A single pouch structure can also be used.

Some additional preferred pouches and detergent compositions are disclosed in commonly assigned U.S. Pat. No. 4,733,774, Ping/Beard, issued March 29, 1988, entitled "Glue Patterned Substrate for Pouched Particulate Fabric Softener Laundry Product"; and U.S. Pat. No. 4,740,326, Hortel/Clauss/Williamson, issued Apr. 26, 1988, entitled "Soil Release Polymer Coated Substrate Containing a Laundry Detergent for Improved Cleaning Performance."

Suitable pouch materials include, paper, nonwoven synthetics such as spun-bonded and wet laid polyester, and porous formed film plastic sheet material. Suitable formed plastic film material is disclosed in commonly assigned U.S. Pat. No. 4,679,643, Curro and Linman, issued Dec. 16, 1986. Said film has finely divided apertures smaller than most of the particulate materials inside and is capable of surviving the wash and dryer temperatures; all incorporated herein by reference in their entirety.

The invention will be illustrated by the following nonlimiting examples. All of the fabric softener compositions in the examples have viscosities of from about 10,000 cps to about 12,000 cps with melting points which range from about 50° C. to about 55° C.

EXAMPLE I

A molten fabric softener composition which has a melting point of about 54° C. is prepared using the following formula:

| Ingredient | Wt. % |
|---|---|
| Ditallowdimethylammonium methylsulfate (DTDMAMS) | 44 |
| Sorbitan monostearate | 22 |
| Cetyl alcohol | 22 |
| Syloid ® 234 (silica gel) | 12 |
| Total | 100 |

The DTDMAMS, cetyl alcohol and sorbitan monostearate are added to a Ross Versamix mixer (Charles Ross & Sons Company, Hauppauge, N.Y. 11788) and blended at 71° C. under vacuum (about 330–430 mm Hg) for one hour. The temperature is then raised to 79° C. -85° C. under vacuum, and when stabilized the Ross anchor and disperser are turned on and the Syloid 234 is added. The mixture is blended for 5 minutes and then sheared with the Ross colloid mixer for 20 minutes.

The molten softener mixture having a viscosity of from about 10,000 cps to about 12,000 cps is then transferred or pumped to the head of a steel belt cooler via heated piping and laid down in the form of drops weighing from about 0.15 gm to about 0.35 gm, each using a Sandvik synchronized dropformer (Sandvik Process Systems, Inc., Totowa, N.J 07512). The belt is cooled via water jets underneath the belt, such that the temperature is significantly below the melting point of the softener, (i.e., 10° C. -20° C.). The drops of molten softener becomes solid particles in about 40 seconds. The solidified softener particles are then removed from the belt and can be used immediately or can be stored until needed. A particle diameter for a 0.15 gram drop is about 10,000 microns and for a 0.35 gram particle about 15,000 microns.

EXAMPLE II

Molten softener of the formula described in Example I is used to make 10,000, 12,000, and 15,000 micron softener particles on a lab scale using a 12-cavity porcelain plate (Fisher Scientific, 711 Forbes Ave., Pittsburgh, Pa., 15219, Catalog #13-745). The plate is placed on an electronic balance and the molten softener is added by weight via a disposable transfer pipette (Fisher Scientific, Catalog #13-711-5A). Particles are formed by dropping molten fabric softener into the cavities of the plate. The weight of the molten softener is measured to control the particle size. In this Example, a 10,000 micron particle weighs about 0.25 gm, a 12,000 micron particle weighs about 0.5 gm, and a 15,000 micron particle weighs about 0.75 gm. (The density of the particular softener formulation determines the weight of softener particles.)

EXAMPLES III & IV

Perfumed softener particles are prepared by first mixing Syloid ® 234 with either of the following perfumes to form a perfumed Syloid particle before it is blended into the molten softener.

| III Substantive Perfume (A) | | IV Relatively Nonsubstantive Perfume (B) | |
|---|---|---|---|
| Component | Wt. % | Component | Wt. % |
| Benzyl Acetate | 5.0 | Alpha Pinene | 5.0 |
| Benzyl Salicylate | 10.0 | Cedarwood Terpenes | 20.0 |
| Coumarin | 5.0 | Dihydro Myrcenol | 10.0 |
| Ethyl Maltol | 5.0 | Eugenol | 5.0 |
| Ethylene Brassylate | 10.0 | Lavandin | 15.0 |
| Galaxolide ® (50%) | 15.0 | Lemon Oil CP | 10.0 |
| Hexyl Cinnamic Aldehyde | 20.0 | Orange Terpenes | 15.0 |
| | | Phenyl Ethyl Alcohol | 20.0 |
| Ionone Gamma Methyl | 10.0 | Total | 100.0 |
| Lilial ® | 15.0 | | |
| Patchouli | 5.0 | | |
| Total | 100.0 | | |

The Syloid and the perfume is blended by first adding 30 lbs. of the Syloid ® 234 to a Littleford Model FM 130 D Mixer (Littleford Bros., 15 Empire Drive, Florence, Ky., 41042). With the plow turned on, the perfume is slowly introduced dropwise through a 3/8 inch pipe at a rate of approximately 2–2.5 lbs/min. After 12.5 lbs. of perfume are added, the chopper is turned on for 15 seconds to evenly disperse the perfume before emptying the mixer.

| Softener Particle Formula | |
|---|---|
| Ingredient | Wt. % |
| Ditallowdimethylammonium methylsulfate (DTDMAMS) | 41.6 |
| Cetyl alcohol | 20.7 |
| Sorbitan monostearate | 20.7 |
| Perfumed Syloid ® 234 | 17.0 |
| Total | 100.0 |

The DTDMAMS, cetyl alcohol and sorbitan monostearate are blended together in a PVM 40 Ross mixer (Charles Ross & Sons Co., Hauppauge, N.Y. 11788) at about 71° C. The molten "triblend" is then mixed for one hour. At the end of one hour, the temperature is raised to 79°-85° C. under vacuum (about 330-430 mm Hg). When the temperature has stabilized in this range, the Ross anchor and disperser are turned on and the perfumed Syloid® 234 is added. The mixer is blended for 5 minutes and then sheared with the Ross colloid mixer for 10 minutes. The viscosities of the molten softeners are from about 10,000 to about 12,000 cps. The softener is then converted into 10,000 to 15,000 micron particles using the methods described in either Example I or II.

EXAMPLE V

A granular detergent/softener composition is prepared by mixing 2.7 parts of the softener particles of Example I, II or III with 97.3 parts of the following granular detergent composition.

| Ingredient | Wt. % |
|---|---|
| Sodium $C_{13}$ linear alkylbenzene sulfonate | 16.5 |
| Sodium $C_{14}$-$C_{15}$ linear fatty alcohol sulfate | 16.5 |
| Sodium sulfate | 23.8 |
| Sodium silicate | 9.2 |
| Polyethylene glycol | 0.9 |
| Polyacrylic acid | 1.3 |
| Sodium tripolyphosphate | 13.7 |
| Sodium carbonate | 4.8 |
| Methyl cellulose | 3.6 |
| Optical brightener | 1.3 |
| Protease enzyme | 1.6 |
| Moisture and miscellaneous | 6.8 |
| Total | 100.0 |

EXAMPLE VI

An alternate detergent/bleach/softener formula is prepared by mixing 1.4 parts of softener particles of Example I, II or III with 98.6 parts of the following detergent composition.

| Ingredient | Wt. % |
|---|---|
| Sodium $C_{13}$ linear alkylbenzene sulfonate | 11.7 |
| Sodium $C_{14}$-$C_{15}$ linear fatty alcohol sulfate | 5.0 |
| Sodium $C_9$ alkyloxybenzene sulfonate | 6.6 |
| Sodium perborate monohydrate | 5.0 |
| Sodium sulfate | 6.8 |
| Sodium silicate | 4.3 |
| Polyethylene glycol | 0.5 |
| Polyacrylic acid | 1.0 |
| Sodium tripolyphosphate | 30.0 |
| Sodium carbonate | 21.4 |
| Optical brightener | 0.2 |
| Protease enzyme | 0.5 |
| Moisture and miscellaneous | 7.0 |
| Total | 100.0 |

EXAMPLE VII

A highly preferred laundering article in the form of a multi-pouch sheet is prepared as follows.

The pouch is comprised of two sheets of James River 9214-02 (James River Corp., Greenville, S.C.), a carded, thermobonded nonwoven composed of a bi-component fiber consisting of a polyester core and a polypropylene sheath. The structure has an outer edge dimension of approximately 4.25 inches × 7.00 inches (10.7 cm × 18.7 cm). The structure is sealed on four edges and across the middle to form two equal sized pouches with outer dimensions of 4.25 inches × 3.5 inches (10.7 cm × 9.4 cm). The center seal is perforated to give the user flexibility to use one pouch for smaller loads of laundry and two pouches for normal loads of laundry.

Each pouch (half sheet) is filled with about 28.3 grams of the detergent/softener composition of Example V. Each pouch contains from about one to about four softener particles depending on the size and the weight of the particles used. It is preferred to use only one particle per pouch, thus the preferred particle weighs about 0.75 gram and is about 15,000 microns in diameter. The finished pouch is used in a washing and softening laundry in a process involving washing and rinsing the fabrics, followed by tumble drying in a heated clothes dryer, wherein the article remains with the laundry throughout the entire process. The jumbo softener particles survive the wash and release in the dryer leaving very little residue staining on the spent pouched sheet.

EXAMPLE VIII

A laundering article containing a detergent, softener and bleach in the form of a multi-pouched sheet is prepared as follows:

The pouch is comprised of two sheets of James River 9214-02 (James River Corp., Greenville, S.C.), a carded, thermobonded nonwoven composed of a bi-component fiber consisting of a polyester core and a polypropylene sheath. The structure has an outer edge dimension of approximately 5.70 inches × 7.33 inches (14.5 cm × 18.6 cm). The structure is sealed on four edges and across the middle to form two equal sized pouches with outer dimensions of 5.70 inches × 3.7 inches (14.5 cm × 9.4 cm). The center seal is perforated to give the user flexibility to use one pouch for small loads of laundry and two pouches for normal loads of laundry.

Each pouch is filled with about 54.8 grams of the detergent/bleach/softener composition of Example VI. The finished pouch is suitable for washing and softening laundry in a process involving washing and rinsing the fabrics, followed by tumble drying in a heated clothes dryer, wherein the article remains with the laundry throughout the entire process.

It should also be noted that the levels of softener used per sheet in Examples VII and VIII are both about 1.5 grams. Those levels are both about 50% of the levels of smaller (1,000 micron) particulate softener used in the Examples of commonly assigned and U.S. patent application Ser. No. 933,824, Wierenga/Clauss/-Culver/-Piatt, filed Nov. 24, 1986, now U.S. Pat. No. 4,828,746 issued May 9, 1989 now U.S. Pat. No. 4,888,643, issued Dec. 26, 1989; and commonly assigned U.S. patent application Ser. No. 190,728, Royce/Kremer/Bisio, filed May 5, 1988, both incorporated herein by reference in their entirety.

The pouched laundering articles described in Examples VII and VIII contain jumbo softener particles which survive the wash at levels of from about 70% to about 100% depending on the temperature of the wash. The pouched laundry articles exhibit release in the dryer of from about 60% to about 80% with no apparent residual softener in the pouched sheet.

What is claimed is:

1. A detergent-compatible, dryer-activated particulate fabric softener composition comprising at least about 10% of a cationic fabric softener, said softener composition having a melting point of from about 40° C. to about 80° C., and a viscosity of from about 5,000 cps to about 25,000 cps at about said melting point, and wherein said particulate composition has a particle size of from about 5 mm to about 30 mm.

2. The detergent-compatible, dryer-activated, particulate fabric softener composition of claim 1 wherein said particle size is from about 7 mm to about 20 mm.

3. The particulate fabric softener composition of claim wherein said particle size is from about 10 mm to about 15 mm.

4. The particulate fabric softener composition of claim 1 wherein said softener has a viscosity of from about 8,000 cps to about 20,000 cps at a temperature of from about 50° C. to about 90° C.

5. The particulate fabric softener composition of claim 1 wherein said particle size is from about 5 mm to about 7 mm and said viscosity is from about 8,000 cps to about 14,000 cps.

6. The particulate fabric softener composition of claim 1 wherein the cationic softener is of the formula $$[R_1R_2R_3R_4N]+Y-$$

wherein one or two of the $R_1$, $R_2$, $R_3$ and $R_4$ groups is an organic radical containing a group selected from $C_{12}$–$C_{22}$ aliphatic radicals having from 10 to 16 carbon atoms in the alkyl chain and alkylbenzyl radicals having from 10 to 16 carbon atoms in the alkyl chain, the remaining groups being selected from $C_1$–$C_4$ alkyl, $C_2$–$C_4$ hydroxyalkyl, and cyclic structures in which the nitrogen atom in the formula forms part of a ring, and wherein Y+ is an anionic radical, and wherein the cationic softener comprises from about 10% to about 50% of the softener composition.

7. The particulate fabric softener composition of claim 1 wherein said composition contains an effective amount of a stain masking adjuvant selected from silica aerogels, xerogels, agglomerated fumed silicates, and mixtures thereof, and wherein said stain masking adjuvant is a particulate material having a particle size of from about 1 micron to about 15 microns and a mean of from about 2 microns to about 4 microns.

8. A process for making particulate, detergent-compatible, dryer-activated fabric softener comprising the steps of:

1. forming drops of molten fabric softener;
2. intimately contacting said drops of molten fabric softener with a cooling device; and
3. quenching said drops of molten fabric softener to a temperature low enough to solidify said drops of molten fabric softener within from about 1 second to about 60 seconds to form particulates; and wherein said particulate has a particle size range of from about 5 mm to about 30 mm.

9. The process of claim 8 wherein said molten fabric softener of Step 1 has a temperature of from about 40° C. to about 100° C.; and said quenching temperature of Step 3 is from about 4° C. to about 38° C.; and the quenching time of Step 3 is from about 20 seconds to about 40 seconds; and wherein said molten fabric softener is cast in a form selected from pastilles, granules or screen printed particles.

10. A quench cooled fabric softener composition made according to the process of claim 9.

11. A product comprising a water-insoluble, water-permeable pouch and the particulate dryer-activated fabric softener composition of claim 10 contained in said pouch.

12. The product according to claim 11 wherein said pouch also contains a laundry wash cycle component selected from detergents and bleaches.

* * * * *

UNITED STATES PATENT AND TRADEMARK OFFICE

CERTIFICATE OF CORRECTION

PATENT NO. : 5,002,681

DATED : March 26, 1991

INVENTOR(S) : Thomas J. Wierenga; Charles A. Hensley; Ricky A. Pollard and Bernard K. Kremer

It is certified that error appears in the above-identified patent and that said Letters Patent is hereby corrected as shown below:

Col. 3, line 15, "dryeractivated" should read -- dryer-activated --.

Col. 12, line 51, "assigned and U.S." should read -- assigned U.S. --.

Col. 12, lines 54-55, delete "now U.S. Pat. No. 4,888,643, issued Dec. 26, 1989".

Col. 12, line 57, after "1988," insert -- now U.S. Pat. No. 4,888,643, issued Dec. 26, 1989; --.

Col. 13, line 11 "claim" should read -- Claim 1 --.

Signed and Sealed this

Third Day of November, 1992

*Attest:*

DOUGLAS B. COMER

*Attesting Officer*

*Acting Commissioner of Patents and Trademarks*